United States Patent [19]

Williams

[11] Patent Number: 5,020,576

[45] Date of Patent: Jun. 4, 1991

[54] WIRE TWISTING MACHINE FOR ELECTRICAL HARNESSES

[75] Inventor: Stuart J. Williams, Houston, Tex.

[73] Assignee: Grumman Aerospace Corporation, Bethpage, N.Y.

[21] Appl. No.: 507,763

[22] Filed: Apr. 12, 1990

[51] Int. Cl.[5] ..... B21F 7/00

[52] U.S. Cl. ..... 140/149; 57/314

[58] Field of Search ..... 140/39, 47, 115, 149; 57/90, 314

[56] References Cited

U.S. PATENT DOCUMENTS

| | | | |
|---|---|---|---|
| 313,634 | 3/1885 | Ulrich | 140/120 |
| 414,319 | 11/1889 | Husted | 140/47 |
| 2,835,283 | 5/1958 | Thone et al. | 140/149 |
| 3,889,455 | 6/1975 | Portinari et al. | 57/314 |
| 4,207,928 | 6/1980 | Pershin et al. | 140/149 |
| 4,813,223 | 3/1989 | Nipper et al. | 57/314 |

OTHER PUBLICATIONS

"Wire Harness Twisting Aid", NASA Tech. Briefs, Spring 1980, vol. 5, No. 1, p. 111.

*Primary Examiner*—Lowell A. Larson

*Attorney, Agent, or Firm*—Pollock, VandeSande & Priddy

[57] ABSTRACT

The present invention offers a machine which is capable of creating contrahelic wound harness sections existing with continuously disposed straight lay wire sections. The invention avoids the necessity of interposing electrical connectors between the contrahelic and straight lay sections thereby vastly improving the reliability and cost considerations of a complex multiwire harness.

7 Claims, 3 Drawing Sheets

WIRE TWISTING MACHINE FOR ELECTRICAL HARNESSES

RELATED PATENT APPLICATION

This application is related to my co-pending patent application Ser. No. 507,787, filed Apr. 12, 1990.

FIELD OF THE INVENTION

The present invention relates to electrical harness fabricating machines, and more particularly to such a machine which is capable of generating straight lay and contrahelic lay sections in a single harness.

BACKGROUND OF THE INVENTION

In the preparation of complex harnesses, numerous wires are required to be twisted and straight layed. Electrical wires which are bundled and in generally parallel configurations are capable of withstanding torsional displacements along a harness axis. However, this basic type of harness suffers a high failure rate when the harness undergoes sharp bends. This is due to the fact that the inside of the bend places the wires thereat in compression while the wires at the outside of the bend are placed in tension.

Contrahelic harnesses have superior performance characteristics when a harness is to be bent. A contrahelic configuration includes helically wound wires wound in a first sense and comprising a first layer while a second coaxial outer layer comprises helically wound wires which are wound in an opposite sense. Although such contrahelic configurations are superior in the area of bends, they are inferior to straight lay wires along straight sections where torsional displacement is experienced by a harness.

In many situations a length of cable is required which must include bends and straight line sections. Conventionally, this is accommodated by employing connectors between straight lay up and contrahelic lay up sections of a harness. The presence of electrical connectors encourages mechanical failures as the cable undergoes motion in torsional and bending modes.

BRIEF DESCRIPTION OF THE INVENTION

The present invention eliminates the failures of connectors between straight and contrahelic sections. This is accomplished by forming straight and contrahelic sections of a single uninterrupted wire harness. As a result, the present invention offers high reliability and cable strength where complex harnesses must be employed such as in the field of robotics.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Figure 1:
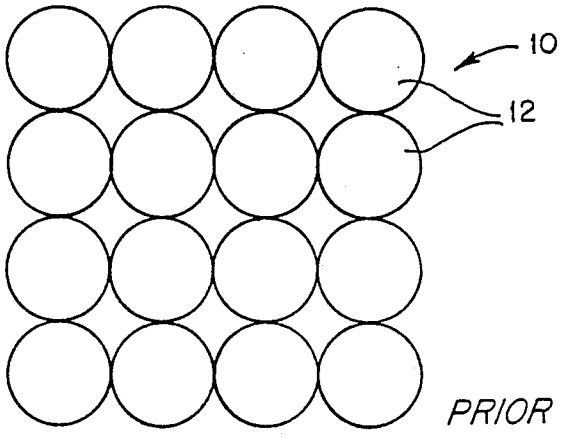
FIG. 1 PRIOR ART
FIG. 1 is a schematic cross-sectional view of a conventional wire harness having straight wires bundled together.

FIG. 1 is a schematic cross-sectional view of a typical wire harness 10 including a plurality of wires 12 bundled together along generally parallel paths. As previously mentioned in the Background of the Invention, this type of straight lay harness performs most satisfactorily where only torsional displacement is experienced by the harness and bending displacement is absent.

Figure 2:
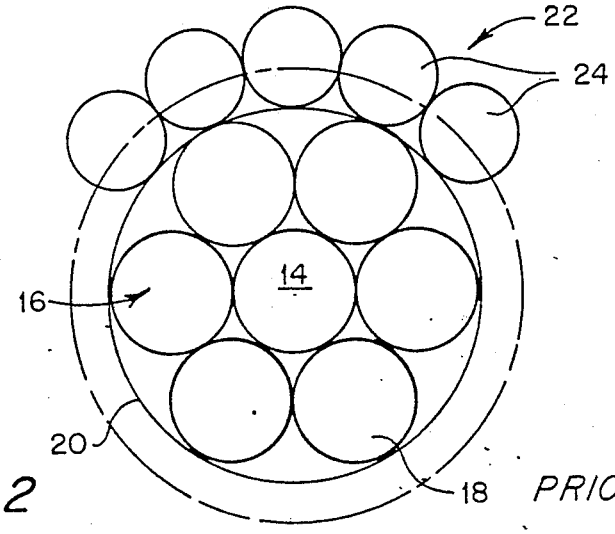
FIG. 2 PRIOR ART
FIG. 2 is a schematic sectional view of a conventional contrahelic harness.

FIG. 2 is a schematic cross-sectional view of a contrahelic harness which includes a central or axially disposed core wire 14 having a first layer 16 of peripheral wires 18 helically wound therearound. All of the wires 18 are wound tightly in the same sense. It has been found that the inclusion of six wires 18, all the same diameter as core wire 14, in the layer 16 permits the formation of a smooth and high performance harness. A second layer 22 comprising wires 24 is disposed circumferentially about the first layer 16 and is coaxial with the core wire 14. Each of the wires 24 is wound in the same helical direction but opposite to those of wires 18 in the radially inward layer 16. It should be mentioned that all of the wires discussed in FIGS. 1 and 2 are intended to be individually insulated with wire jackets. In order to reduce the friction between the wires of the first layer 16 and the outer layer 22, a thin, smooth sleeve 20 is positioned between the layers. Typical materials that will serve satisfactorily include MYLAR and KAPTON. The resulting contrahelic structure of FIG. 2 exhibits high resistance to failure along bends as compared with the straight lay section of FIG. 1.

Figure 3:
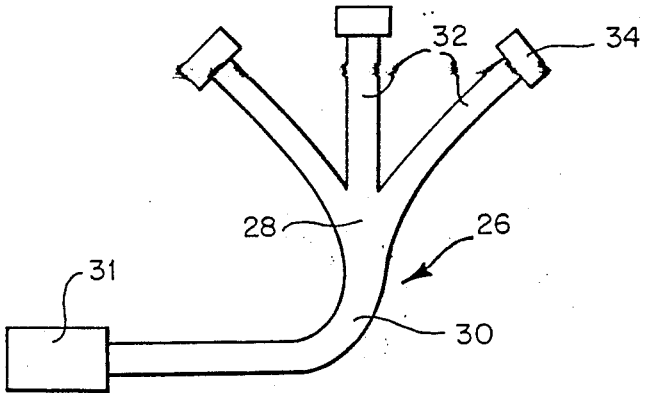
FIG. 3 is a schematic illustration of a complex electrical harness having straight lay up sections and contrahelic sections formed along a single continuous harness in accordance with the present invention.

As previously mentioned in the Background of the Invention, it is often required for a harness to undergo bends and torsional displacement at different points along the length of the harness. This is accommodated by harness 26 shown in FIG. 3 which includes a straight section 28 extending downwardly to a bend 30. The upper end of the straight section 28 extends to branches 32 which terminate in connectors 34. If the branches 32 undergo bending, it would be best to have them fabricated as contrahelic sections connected with the straight lay section 28. The remaining lower section including bend 30 would be most advantageously fabricated as a contrahelic section due to the bend 30. The outward end of the lower illustrated harness section terminates in a connector 31. Thus, with harness 26 as shown and described, control and power signals could be delivered from connector 31 to movable robotic members connected to connectors 34. Although such straight lay—contrahelic lay sections in a single harness now exist, they require the additional inclusion of connectors between each straight lay section and contrahelic section. It is precisely the elimination of these connectors which forms the principal purpose of the present invention.

Figure 4:
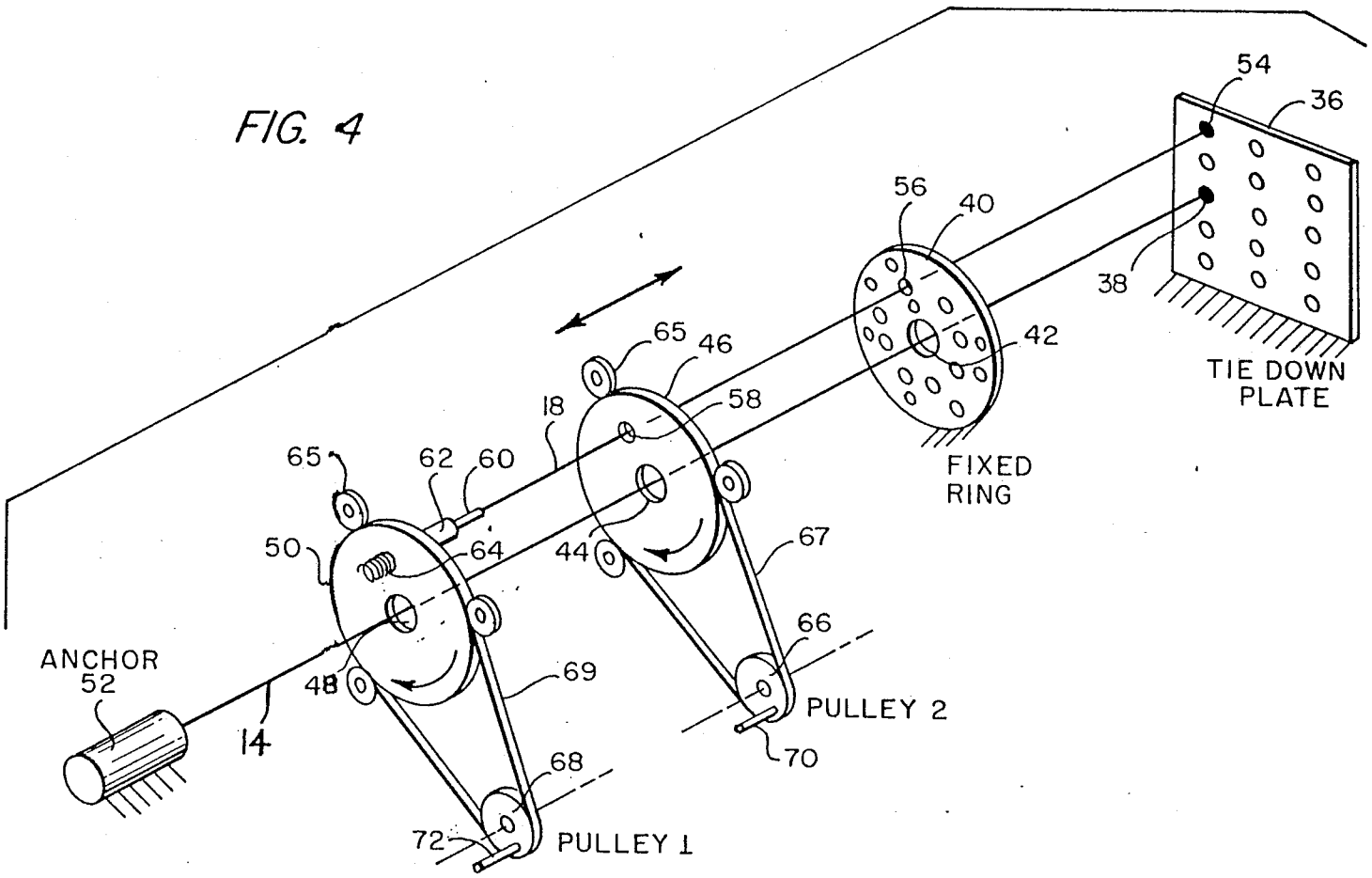
FIG. 4 is a schematic perspective view of an apparatus which forms a continuous harness having straight lay up and contrahelic lay up sections in accordance with the present invention.
Figure 5:
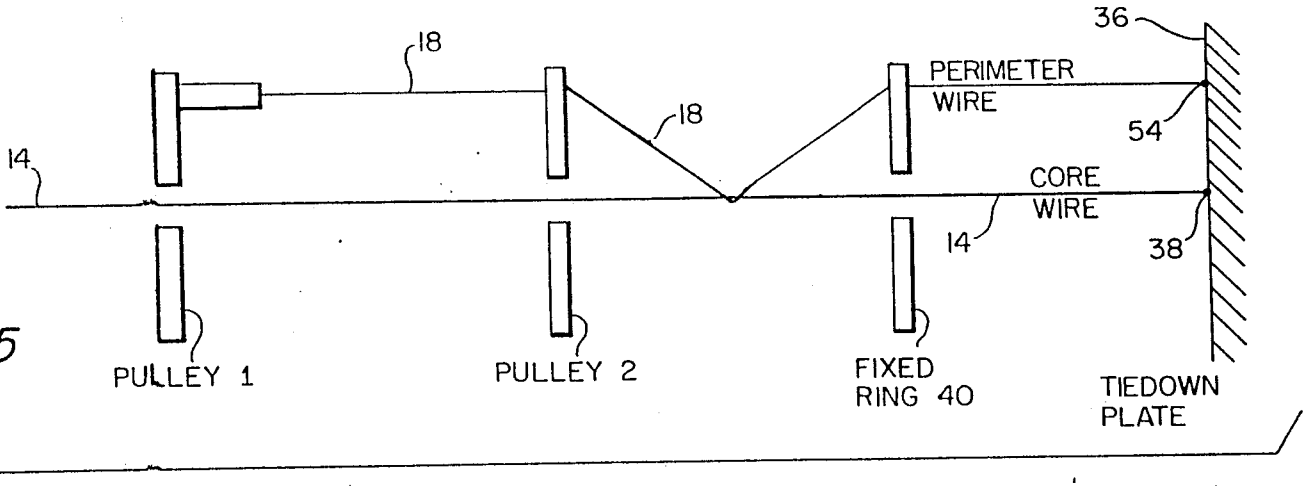
FIG. 5 is a schematic illustration of the mechanism of the present invention after a single contrahelic winding has been perfected.
Figure 6:
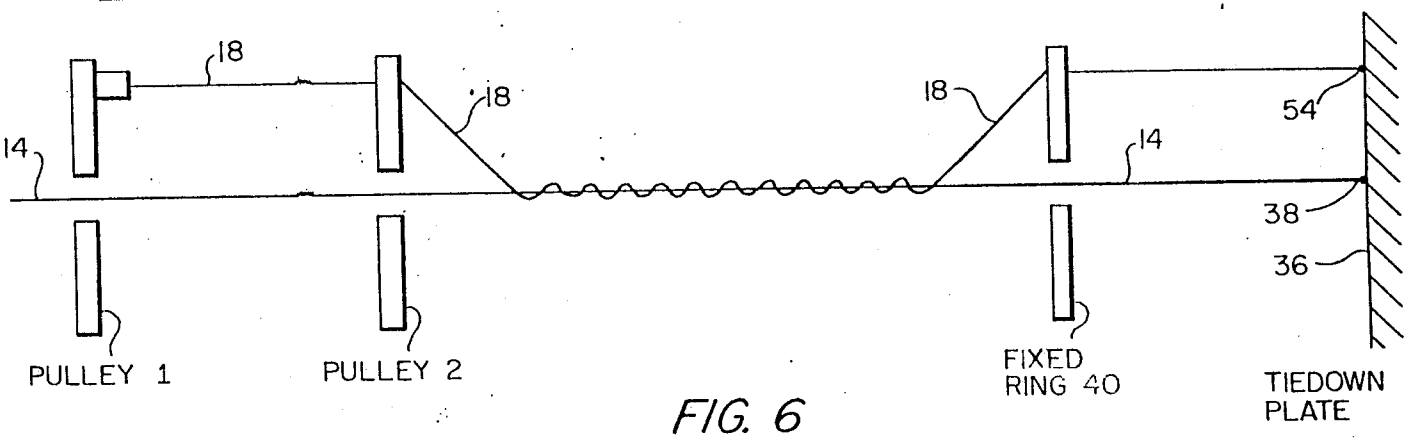
FIG. 6 is a view similar to that of FIG. 5 but showing a completed contrahelic section with multiple turns completed therein.

In order to explain the mechanism of the present invention in fabricating such a continuous high flex multiconductor harness without connectors being present between straight lay and contrahelic lay sections, reference is made to FIGS. 4–6. In FIG. 4, the core wire 14 is seen to be tied at its right end to point 38 on a tie-down plate 36. The core wire 14 extends through a central opening 42 in a fixed ring 40. Continuing from right to left, the core wire 14 continues through a central opening 44 formed in a pulley wheel 46 which can translate bidirectionally along the wire 14. The core wire then continues through an identical opening 48 in another pulley wheel 50 for taut attachment to an anchor 52. During the following description of the mechanism and its operation, core wire 14 will remain stationary. In order to wrap the first contrahelic wire 18 around the core wire 14, the contrahelic wire 18 is positioned as a straight wire, beginning at tie-down point 54 on the tie-down plate 36. The wire 18 is then passed through an opening 56 in the fixed ring 40, the opening 56 being radially outward from the central opening 42. Continuing in a right to left direction, the wire 18 then continues through an opening 58 in the pulley wheel 46, the latter-mentioned opening being radially outward from the central opening 44 by the same radial distance as opening 56 exists relative to central opening 42 in the fixed ring 40. The wire 18 is then clamped within a collet 60 fixed to pulley wheel 50, the collet being free to rotate in bearing 62. Pulley wheel 50 is identical to that of 46 in shape and dimension. The collet and bearing (60, 62) are radially displaced from the central opening 48 by the same distance that opening 58 is radially disposed relative to the central opening 44. A collet spring 64 takes up any slack which develops along wire 18 during operation of the illustrated mechanism. Since the center of both pulley wheels 46 and 50 have openings as opposed to central axles, bearings 65 are located along the periphery of each pulley wheel so as to furnish support thereto.

In order to form a helical winding in wire 18, it is necessary to rotate the wire 18 relative to 14. FIG. 5 schematically illustrates the creation of the first helical winding for a harness where the central section will include contrahelical windings while the two outer end sections of the harness will include straight lay sections. To accomplish this alternating helical-straight lay configuration, it is necessary to rotate pulley 2 relative to fixed ring 40. After one rotation of pulley 2, a single winding of 18 is created relative to the centrally positioned wire 14. However, if pulley 1 and pulley 2 are rotated in the same sense at the same time, the wires 14 and 18 to the left of pulley 2 remain parallel and unwound. This will be a section of straight lay-up cable when the harness is finally completed. Likewise, the wires 14 and 18 to the right of fixed ring 40 remain parallel so that this end of the harness will create a straight lay section. The pulley wheels 50 and 46 are respectively part of pulley 1 and pulley 2 which are driven, in its simplest form, by cranks 72 and 70 (FIG. 4). The latter cranks are connected to respective driving pulley wheels 68 and 66 which have corresponding belts 69 and 67 for entraining both pulley wheels of pulley 1 and pulley 2. Pulley 1 turns in place while pulley 2 is translated toward pulley 1 to form the helical pattern of wire 18, relative to the fixed wire 14. After pulley 2 has traveled sufficiently toward pulley 1, a number of helical windings have been formed, as schematically illustrated in FIG. 6. It should be pointed out that FIGS. 4–6 illustrate the creation of a single helical section for a single wire. However, if six wires 18 were positioned in the machine shown in FIG. 4, then the preceding description would result in the formation of six helically wound wires in the radially inward layer 16 (FIG. 2).

At the completion of the helical layer formation, the ends of the wound wires are removed from the tie-down point 54 and collet 60, the ends pulled back through holes 56 and 58 respectively, re-fed through holes 42 and 44 respectively, and temporarily fastened to the core wire 14. Then, a MYLAR or KAPTON tape strip is wound over the wires 18 to form sleeve 20. A second set of wires 24 is then inserted into the machine and the previous operation is repeated to form a contrahelic layer 22 (FIG. 2) after pulley 2 is moved to its initial position and the pulley is turned in an opposite direction. The opposite winding of radially adjacent layers permits the contrahelic section to successfully withstand repeated bending displacements. In a preferred embodiment the present invention, the number of wires 24, in the second radially outward layer 22 is 12 wires. This will occur when the same diameter exists for core wire 14 and all the wires in layers 16 and 22.

At the conclusion of the formation of the contrahelic layer 22, individual wires 24 of this layer may be unfastened at their end points and since straight (unwound) wire sections exist between pulley 1 and pulley 2 as well as between fixed ring 40 and tie-down plate 36, the straight wires may be bundled together to form a straight lay sections on either side of the central contrahelic lay section.

Although the present invention has been described in terms of manually cranking pulley 1 and pulley 2, in a preferred embodiment of the present invention these pulleys would be driven by stepper motors to create evenly wound contrahelic wires.

Further, although the present invention has been described in terms of two layers of contrahelic wires, it should be understood that a greater number of layers may be successfully formed by employing the present invention.

By virtue of the preceding description of the present invention, it will be appreciated that a multiple wire complex harness may be fabricated which has both straight lay sections and contrahelic sections existing in a single continuous harness which provides for electrical continuity therethrough without the interposition of electrical connectors.

It should be understood that the invention is not limited to the exact details of construction shown and described herein for obvious modifications will occur to persons skilled in the art.

I claim:

1. A wire-twisting machine for fabricating straight and contrahelically wound sections comprising:

means for securing a first wire between first and second fixed end means;

first and second coaxially spaced pulley wheels located inwardly of the fixed points and having central openings therein through which the first wire passes;

stationary guide means located between the second pulley wheel and the second fixed end means, the guide means having a coaxially located central opening for allowing the first wire to pass therethrough;

a second wire secured to a radially outward point on the first pulley wheel and positioned in parallel spaced relation to the first wire;

radially outward openings formed in the second pulley wheel and the guide means for passing the second wire for securement to a point on the second fixed end means; and means for rotating the pulley wheels in synchronous rotation while undergoing limited translation therebetween wherein the second wire is helically wound around the first wire between the second pulley wheel and the guide means while the first and second wires remain parallel and unwound outwardly of the second pulley wheel and the guide means.

2. The subject matter set forth in claim 1 together with bearing means engaging the pulley wheel perimeters for permitting their free synchronous rotation.

3. The subject matter set forth in claim 1 wherein the radially outward openings on the guide means are displaced by an equal radial distance from the central openings therein.

4. A wire-twisting machine for fabricating straight and contrahelically wound sections comprising:

means for securing a first group of wires between first and second fixed end means;

first and second coaxially spaced pulley wheels located inwardly of the fixed points and having central openings therein through which the first group of wires passes;

stationary means located between the second pulley wheel and the second fixed end means, the guide means having a coaxially located central opening for allowing the first group of wires to pass therethrough;

a second group of wires secured to a radially outward point on the first pulley wheel and positioned in parallel spaced relation to the first group of wires;

radially outward openings formed in the second pulley wheel and the guide means for passing the second wire group for securement to a point on the second fixed end means; and means for rotating the pulley wheels in synchronous rotation while undergoing limited translation therebetween the second group of wires is helically wound as a layer around the first group of wires between the second pulley wheel and the guide means while the first and second groups of wires remain parallel and unwound outwardly of the second pulley wheel and the guide means.

5. The subject matter set forth in claim 4 together with bearing means engaging the pulley wheel perimeters for permitting their free synchronous rotation.

6. A method for fabricating continuous straight and contrahelical wire sections comprising the steps:

securing a first group of wires between first and second fixed end points;

helically winding a median section of a second group of wires, as a layer, around the median section of the first wire group; and bundling the outward ends of the first and second wire sets to form corresponding straight sections.

7. The method set forth in claim 6 together with the step of helically winding a median section of a third group of wires, as a layer, around the median section of the second wire group to form a contrahelical layer, the outward ends of the third group being then bundled with the bundled ends of the first and second wire group to form straight end sections.

* * * * *

UNITED STATES PATENT AND TRADEMARK OFFICE

CERTIFICATE OF CORRECTION

PATENT NO. : 5,020,576

DATED : June 4, 1991

INVENTOR(S) : Stuart J. Williams

It is certified that error appears in the above-identified patent and that said Letters Patent is hereby corrected as shown below:

Column 4, line 18, after "embodiment" insert --of--.

Column 4, line 28, change "sections" to --section--.

Column 5, line 28, after "stationary" insert --guide--.

Column 6, line 10, after "therebetween" insert --wherein--.

Signed and Sealed this

Thirteenth Day of October, 1992

*Attest:*

DOUGLAS B. COMER

*Attesting Officer*

*Acting Commissioner of Patents and Trademarks*